United States Patent [19]

Sobajima

[11] 4,264,074

[45] Apr. 28, 1981

[54] APPARATUS FOR AUTOMATIC ARRANGEMENT OF MAH-JONGG TILES

[76] Inventor: Iwazo Sobajima, 2-26, 3-chome, Takakura-cho, Miyakojima-ku, Osaka-shi, Osaka-fu, Japan

[21] Appl. No.: 64,023

[22] Filed: Aug. 6, 1979

[30] Foreign Application Priority Data

Aug. 4, 1978 [JP] Japan ..... 53-95608

[51] Int. Cl.[3] ..... A63F 9/20

[52] U.S. Cl. ..... 273/149 R; 273/309

[58] Field of Search ..... 273/149 R, 309

[56] References Cited

U.S. PATENT DOCUMENTS 3,899,178 8/1975 Watanabe ..... 273/149 R

*Primary Examiner*—Anton O. Oechsle

*Attorney, Agent, or Firm*—Wenderoth, Lind & Ponack

[57] ABSTRACT

An apparatus for automatically arranging the Mah-Jongg tiles on a Mah-Jongg board in parallel with the four edges thereof. Two horizontal rows of Mah-Jongg tiles are automatically formed at the starting point of a Mah-Jongg tile conveyor system incorporated in the apparatus. These two horizontal rows of Mah-Jongg tiles are rearranged in two vertical tiers in the course of being thrusted forward in the Mah-Jongg tile conveyor system.

6 Claims, 13 Drawing Figures

APPARATUS FOR AUTOMATIC ARRANGEMENT OF MAH-JONGG TILES

The present invention relates to an apparatus for automatically arranging the Mah-Jongg tiles on a Mah-Jongg board, and more particularly to an apparatus for automatically arranging the Mah-Jongg tiles on a Mah-Jongg board in parallel with the four edges thereof so that four players can begin to play Mah-Jongg without going through the trouble of manually arranging the Mah-Jongg tiles.

It is an object of the present invention to provide an apparatus in which two horizontal rows of Mah-Jongg tiles are automatically formed at the starting point of a Mah-Jongg tile conveyor system incorporated in the apparatus.

It is another object of the present invention to provide an apparatus in which two horizontal rows of Mah-Jongg tiles are rearranged in two vertical tiers in the course of being thrusted forward in the Mah-Jongg tile conveyor system.

It is still another object of the present invention to provide an apparatus which is compact enough to be mounted on the under surface of a Mah-Jongg board.

With these objects in view which will become apparent from the following detailed description, the present invention will be more clearly understood in connection with the accompanying drawings, in which.

Figure 1:
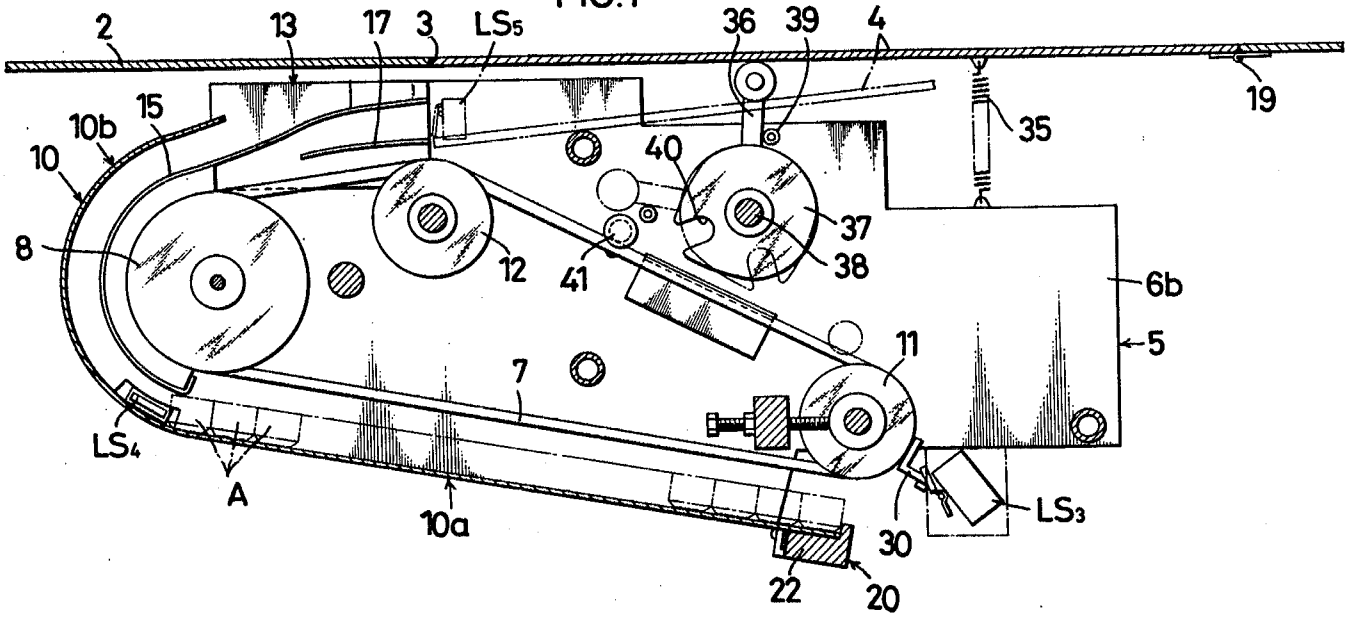
FIG. 1 is a vertical section of an apparatus according to the present invention.
Figure 2:
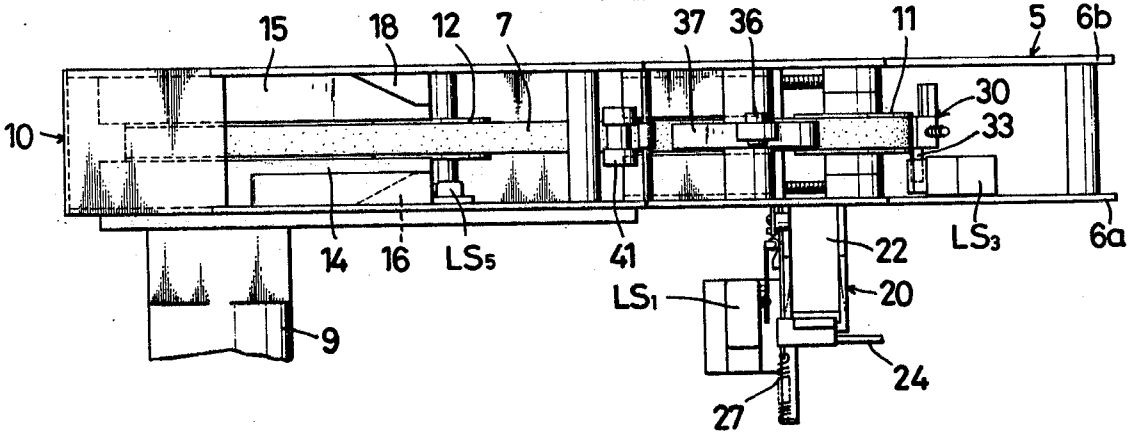
FIG. 2 is a plan view thereof.

Referring now to FIGS. 1 and 2, an apparatus in accordance with the present invention includes a Mah-Jongg board 2 provided with four rectangular openings 3 in the proximity of four edges of the board 2, respectively, in such a manner that the longitudinal edges of each rectangular opening 3 run parallel to each edge of the board 2. Each opening 3 has such dimensions that two vertical tiers of Mah-Jongg tiles, with each tier consisting of seventeen Mah-Jongg tiles A and with the longitudinal axis of each Mah-Jongg tile A placed perpendicularly to the edge of the board 2, can barely pass therethrough. A rectangular board 4, which fits in each opening 3 and is adapted to turn on a hinge 19 provided on one of the transverse edges thereof, is urged downwardly by a tension coil spring 35.

The apparatus for conveying and arranging the Mah-Jongg tiles is generally designated by the numeral 5. A unit of the apparatus 5, which is held between two side plates 6*a* and 6*b*, is installed under each opening 3 in such a manner that the side plates 6*a* and 6*b* run parallel to the longitudinal edges of the opening 3. The space left between the side plates 6*a* and 6*b* is just enough to allow two horizontal rows of Mah-Jongg tiles A to barely pass therethrough, with the longitudinal axis of each Mah-Jongg tile A placed perpendicularly to the side plates 6*a* and 6*b*.

The apparatus 5 includes three pulleys 8, 11 and 12. Of these three pulleys, the pulley 8 is placed in the remotest position from the hinge 19. The pulley 11 is placed in the lower part of the space between the side plates 6*a* and 6*b* in the proximity of the vertical edges thereof that are nearer to the hinge 19, while the pulley 12 is placed directly under one of the transverse edges of the opening 3 which is not provided with the hinge 19. The pulley 8 is driven by a motor 9 mounted on the side plate 6*a* so as to allow an endless belt 7 to run in the grooves provided in the rims of the pulleys 8, 11 and 12.

The edges of the side plates 6*a* and 6*b* are joined by a guide plate 10 which serves for guiding the Mah-Jongg tiles A from a Mah-Jongg tile supply system 20 to the opening 3. The guide plate 10 partially surrounds the endless belt 7 in such a manner that one end of the guide plate 10 terminates directly under the pulley 11 and is provided with the Mah-Jongg tile supply system 20, while the other end of the guide plate 10 terminates over the pulley 8. The guide plate 10 comprises a straight portion 10*a* which runs parallel to the endless belt 7 at the interval between the pulleys 11 and 8, and a substantially semicircular portion 10*b* which is adjoined to the portion 10*a* and surrounds nearly half of the pulley 8 concentrically therewith.

Figure 5:
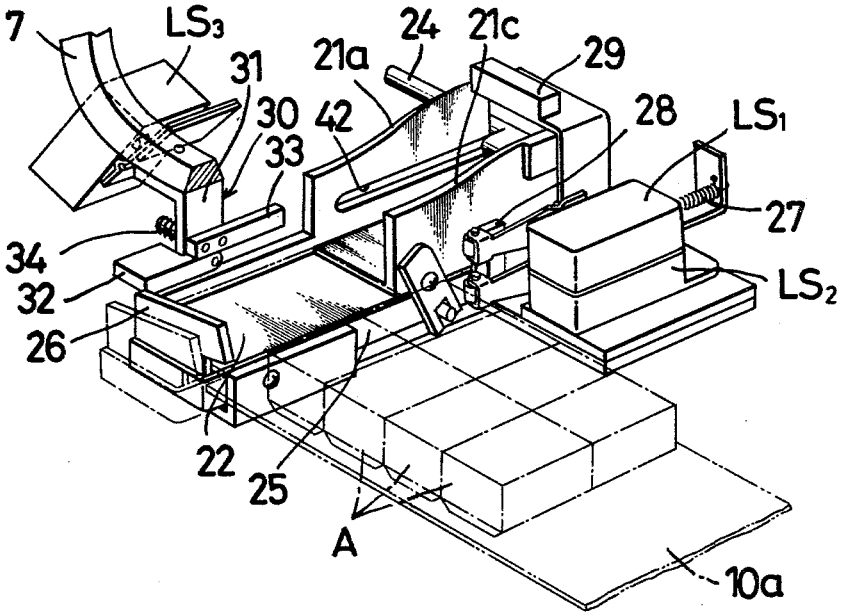
FIG. 5 is a perspective view thereof.

The straight portion 10*a* is just long enough to allow thirty-four Mah-Jongg tiles A to be arranged in two horizontal rows so that each row may consist of seventeen Mah-Jongg tiles A, with the longitudinal axis of each Mah-Jongg tile A placed perpendicularly to the running direction of the endless belt 7 as shown in FIG. 5.

In the course of passage through the semicircular portion 10*b*, two horizontal rows of the Mah-Jongg tiles A thrusted thereinto from the straight portion 10*a* are allowed to turn upside down. For this purpose, guide rails 14 and 15 are fixed to the side plates 6*a* and 6*b*, respectively. In the region surrounded by the semicircular portion 10*b*, the guide rails 14 and 15 are concentric with the pulley 8, and a space substantially equal to the thickness of a Mah-Jongg tile A is left between these guide rails and the semicircular portion 10*b* of the guide plate 10.

Figure 6:
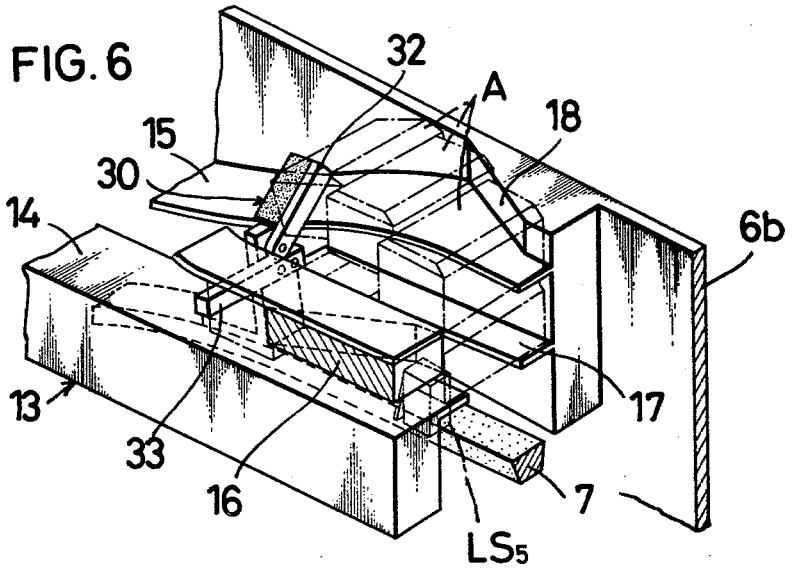
FIG. 6 is a perspective view of the last portion of the Mah-Jongg tile conveyor system in which Mah-Jongg tiles arranged in two horizontal rows are being rearranged in two vertical tiers.

Referring now to FIGS. 6 and 9, the last portion of the Mah-Jongg tile conveyor system, which is adjoined to the portion 10*b*, is generally designated by the numeral 13. The guide rail 14 extends straightforward throughout the portion 13. By means of a guide 16 provided on the guide rail 14 at the end of the portion 13, the Mah-Jongg tiles A sliding on the guide rail 14 while keeping in touch with the side plate 6*a* are deflected toward the center between the side plates 6*a* and 6*b* and supported by an auxiliary guide rail 17 which is provided on the side plate 6*b* on the same level with the guide rail 14.

The guide rail 15 forms a gradual ascent in relation to the guide rail 14 until the difference of altitude between the guide rails 14 and 15 comes to be substantially equal to the thickness of the Mah-Jongg tiles A. By means of a guide 18 provided on the guide rail 15 at the end of the portion 13, the Mah-Jongg tiles A sliding on the guide rail 15 while keeping in touch with the side plate 6b are deflected toward the center between the side plates 6a and 6b until these Mah-Jongg tiles are laid on top of those sliding astride the guide rail 14 and the auxiliary guide rail 17.

Figure 3:
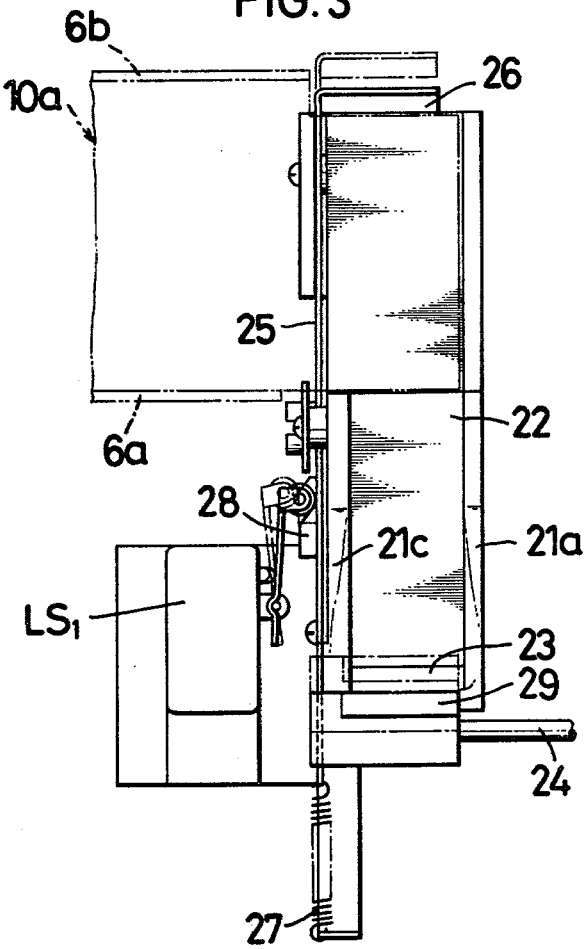
FIG. 3 is an enlarged plan view of a Mah-Jongg tile supply system incorporated in the apparatus.
Figure 4:
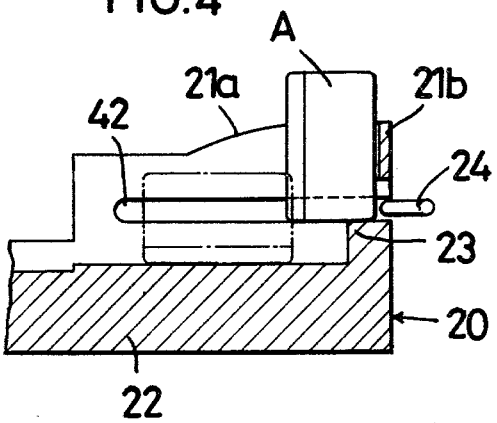
FIG. 4 is a vertical section of said system.

Referring now to FIGS. 1 to 5, the Mah-Jongg tile supply system 20 includes a rectangular cradle 22, which is nearly twice as long as the width of the guide plate 10. One of the longitudinal edges of the rectangular cradle 22 is in contact with the transverse edge of the straight portion 10a of the guide plate 10 in such a manner that the upper surface of the cradle 22 is on a level with that of the straight portion 10a and that one of the transverse edges of the cradle 22 is slightly set back from the extension of the lower edge of the side plate 6b. Thus a space is left between the transverse edge of the cradle 22 and the extension of the lower edge of the side plate 6b. As a consequence, nearly half of the cradle 22 projects sideways beyond the extension of the lower edge of the side plate 6a perpendicularly thereto. The projecting portion of the cradle 22 is surrounded by walls on three sides. These walls are designated by the numerals 21a, 21b and 21c as shown in FIGS. 3, 4 and 5. The space left between the walls 21a and 21c is slightly larger than the width of a Mah-Jongg tile A.

A slit 42 provided horizontally in the wall 21a communicates at one end with another slit provided likewise horizontally in the wall 21b so that a push rod 24 may make a horizontal motion over the surface of the cradle 22 in the longitudinal direction thereof, with the axis of the push rod 24 kept parallel to the longitudinal axis of the straight portion 10a.

A rectangular projection 23 is provided inside the wall 21b along the intersection formed by the wall 21b and the cradle 22. The upper surface of the rectangular projection 23 is on a level with, or lower than, the lower edge of the slit 42. The depth of the rectangular projection 23 is less than half the thickness of a Mah-Jongg tile A so that, when the lower surface of a Mah-Jongg tile A falling from the Mah-Jongg tile feeder (not shown) strikes against the upper surface of the rectangular portion 23, the Mah-Jongg tile A may spontaneously fall to the cradle 22.

A slide bar 25 provided under, and in parallel with, the boundary between the straight portion 10a and the cradle 22 is adapted for axial reciprocation. One end of the slide bar 25 is provided with a bumping plate 26, which substantially makes a right angle with the slide bar 25 and projects above the surface of the cradle 22 in the space left between the transverse edge of the cradle 22 and the extension of the lower edge of the side plate 6b. When a tension coil spring 27 connected to the other end of the slide bar 25 is in a slackened state, the space between the bumping plate 26 and the extension of the lower edge of the side plate 6a is not enough to admit two Mah-Jongg tiles A arranged in such a manner that the longitudinal axis of each Mah-Jongg tile A is substantially aligned with each other.

The slide bar 25 is provided with a protuberance 28 on the side reverse to the side facing the wall 21c so that limit switches $LS_1$ and $LS_2$ may be actuated by the protuberance 28 when the slide bar 25 makes reciprocating motion.

The end of the slide bar 25 connected to the tension coil spring 27 is provided with a member 29, which is adapted to hang over the rectangular projection 23 when the slide bar 25 is moved against the tension of the coil spring 27. Namely, the member 29 serves to prevent a Mah-Jongg tile A from dropping to the rectangular portion 23 while the push rod 24 is in motion.

Two Mah-Jongg tiles A arranged in the portion of the cradle 22 lying between the side plates 6a and 6b are pushed out of the cradle 22 in the longitudinal direction of the straight portion 10a by means of a thrusting member 30 mounted on the outside surface of the endless belt 7. The thrusting member 30 includes a bracket 31 fixed to the endless belt 7. A thrusting rod 33, which is fixed to the end of the bracket 31 so as to point to the side plate 6a perpendicularly thereto, is kept parallel to the surface of the guide plate 10 throughout the operation of the apparatus 5. Another thrusting rod 32 is adapted to turn counterclockwise in FIGS. 5 and 6 on a pin with which it is mounted on the end of the bracket 31, so that two rows of the Mah-Jongg tiles A sliding on different levels in the portion 13 may be effectively thrusted by the thrusting rods 32 and 33, respectively. The thrusting rod 32 is urged by a coil spring 34 so as to be kept parallel to the surface of the guide plate 10 until the thrusting rod 32 comes to the gradual ascent formed by the guide rail 15 in relation to the guide rail 14.

A shaft 38 is perpendicularly fixed to the side plates 6a and 6b substantially under the center of the rectangular board 4 and over the endless belt 7. A disk 37 is rotatably mounted on the shaft 38. A limit in the clockwise rotation of the disk 37 is set by a stopper 39. A push-up rod 36 radially provided on the periphery of the disk 37 is adapted to come in a vertical state when it comes in touch with the stopper 39. The push-up rod 36 is just long enough to support the rectangular board 4 on a level with the board 2 as long as the push-up rod 36 is in touch with the stopper 39.

In operation, each Mah-Jongg tile A fed by a Mah-Jongg tile feeder (not shown) falls along the wall 21b, with the obverse of the Mah-Jongg tile A facing on the wall 21b and with the longitudinal axis of the Mah-Jongg tile A kept perpendicular to the upper surface of the cradle 22.

When the lower surface of a Mah-Jongg tile A strikes against the upper surface of the rectangular portion 23, the Mah-Jongg tile A falls to the cradle 22 with the obverse upward and with the longitudinal axis of the Mah-Jongg tile A placed perpendicularly to the running direction of the endless belt 7.

When the Mah-Jongg tile A has fallen to the cradle 22, the push rod 24 makes a horizontal motion over the surface of the cradle 22 and thrusts the Mah-Jongg tile A into the portion of the cradle 22 lying between the extensions of the lower edges of the side plates 6a and 6b.

As soon as the push rod 24 returns to the original position, the second Mah-Jongg tile A drops from the Mah-Jongg tile feeder and falls to the cradle 22. The push rod 24 makes a horizontal motion again and thrusts the second Mah-Jongg tile A into the portion of the cradle 22 lying between the extensions of the lower edges of the side plates 6a and 6b. Then the second Mah-Jongg tile A clashes against the first Mah-Jongg tile A from behind and thereby causes the latter to clash against the bumping plate 26. Then the slide bar 25 is moved against the tension of the coil spring 27 and allows the protuberance 28 to actuate the limit switch $LS_1$. When the limit switch $LS_1$ is actuated, it energizes the motor 9 so as to drive the pulley 8 clockwise in FIG. 1 and thereby cause the two Mah-Jongg tiles A to be pushed out of the cradle 22 and thrusted into the straight portion 10*a* by means of the thrusting member 30.

When the two Mah-Jongg tiles A have been thrusted into the straight portion 10*a*, the slide bar 25 is returned to the original position by the tension of the coil spring 27, and the lever of the limit switch $LS_2$ is released from depression which has been applied thereto by the protuberance 28. Then the limit switch $LS_2$ is actuated to energize the motor 9 so as to reverse the direction of rotation of the pulley 8. The endless belt 7 is thereby run in the reverse direction to such an extent that the thrusting member 30 overruns the cradle 22 and causes the thrusting rod 33 to strike against a limit switch $LS_3$ allotted for de-energizing and stopping the motor 9.

The above-mentioned operation is repeated until thirty-four Mah-Jongg tiles A are arranged in two horizontal rows in the straight portion 10*a*, with each row consisting of seventeen Mah-Jongg tile A and with the longitudinal axis of each Mah-Jongg tile A placed perpendicularly to the running direction of the endless belt 7 as shown in FIG. 5. Then, one of the two Mah-Jongg tiles A which are at the head of the rows strikes against a limit switch $LS_4$ provided on the boundary between the straight portion 10*a* and the semicircular portion 10*b*. Then the limit switch $LS_4$ is actuated to energize the motor 9 so as to drive the pulley 8 clockwise in FIG. 1 and thereby run the endless belt 7 to the extent of allowing the thrusting member 30 to thrust the Mah-Jongg tiles A into the semicircular portion 10*b* and further into the portion 13.

When the endless belt 7 is run in the clockwise direction in this manner, a cam 41 mounted on the outside surface of the endless belt 7 engages with a notch 40 provided in the periphery of the disk 37. As a consequence, the push-up rod 36 is thrown down to the position shown with an alternate long and short dash line in FIG. 1. Then the rectangular board 4 is turned on the hinge 19 by the tension of the coil spring 35 until the rectangular board 4 comes to be aligned with the guide rail 14.

Figure 7:
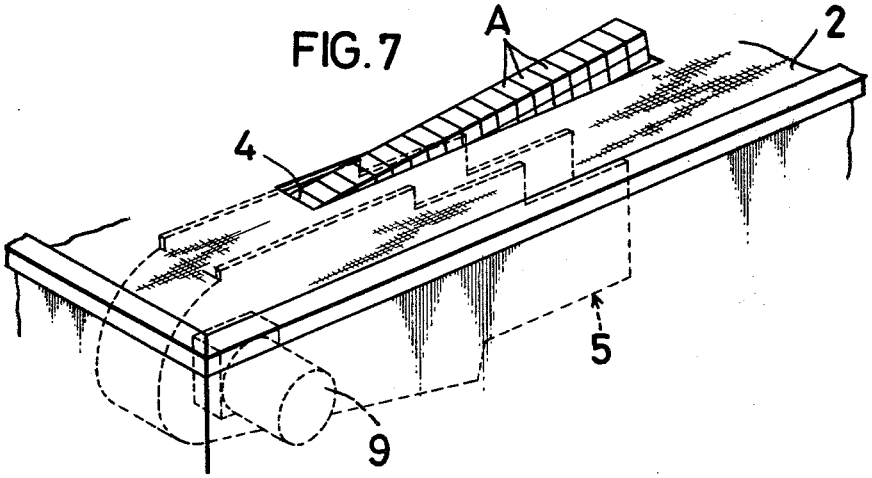
FIG. 7 is a perspective view showing two vertical tiers of Mah-Jongg tiles coming up to the surface of the Mah-Jongg board.

As already mentioned in reference to FIGS. 6 and 9, the Mah-Jongg tiles A are rearranged in two vertical tiers in the portion 13 in the course of being thrusted forward on the guide rails 14 and 15. Then, two vertical tiers of Mah-Jongg tiles A are thrusted onto the rectangular board 4 as shown in FIG. 7, and the thrusting rod 33 strikes against a limit switch $LS_5$ provided at the terminal end of the portion 13. Then the limit switch $LS_5$ is actuated to energize the motor 9 so as to reverse the direction of rotation of the pulley 8. The endless belt 7 is thereby run in the reverse direction to such an extent that the thrusting member 30 is returned to the original position and the thrusting rod 33 strikes against the limit switch $LS_3$ again. The motor 9 is thereby de-energized and stopped.

Figure 8:
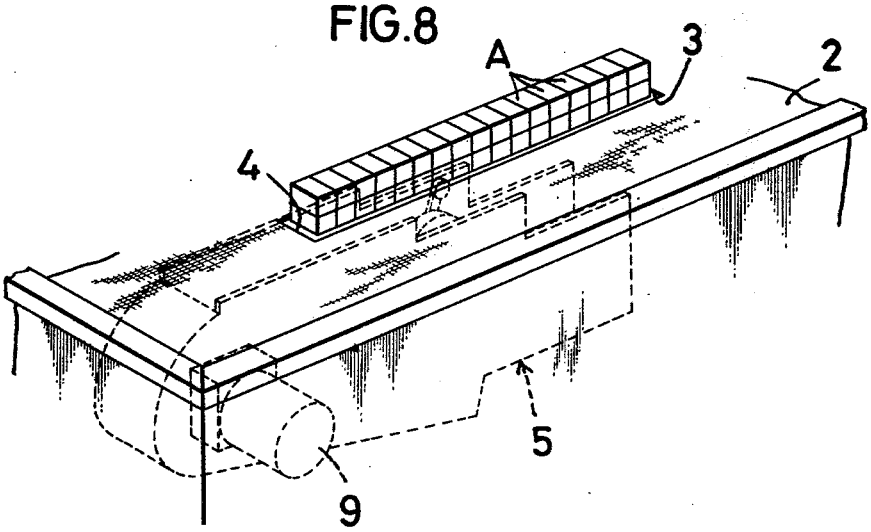
FIG. 8 is a perspective view showing two vertical tiers of Mah-Jongg tiles made ready for the start of play.
Figure 9A:
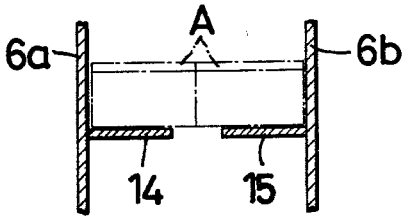
FIGS. 9*a* to 9*e* are cross-sectional views showing the sequent order in which Mah-Jongg tiles arranged in two horizontal rows are rearranged in two vertical tiers.
Figure 9B:
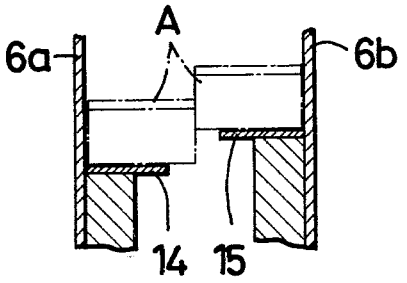
Figure 9C:
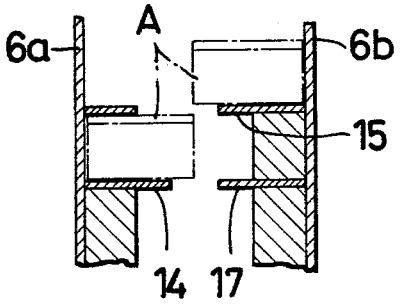
Figure 9D:
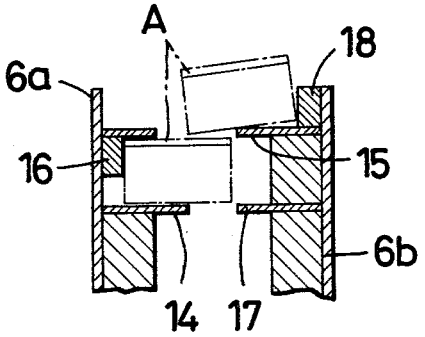
Figure 9E:
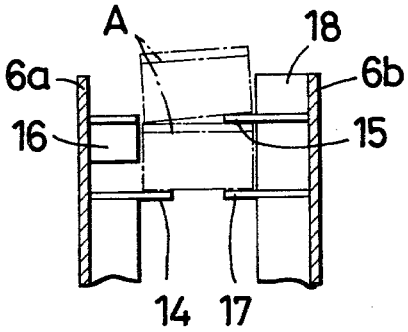

Meanwhile, in the course of running in the reverse direction (i.e., in the counterclockwise direction in FIG. 1), the endless belt 7 allows the cam 41 to engage with the notch 40 again. As a consequence, the push-up rod 36 is turned clockwise on the shaft 38 to such an extent that the push-up rod 36 strikes against the stopper 39 while pushing up the rectangular board 4 to the same level with the board 2. Now, two vertical tiers of Mah-Jongg tiles are made ready for the start of play, as shown in FIG. 8. This applies to four rectangular openings 3 provided in the proximity of four edges of the board 2.

While I have disclosed only one embodiment of the present invention, it is to be understood that this has been given by way of example only and not in a limiting sense, the scope of the present invention being determined by the objects and the claims.

What I claim is:

1. An apparatus for automatically arranging the Mah-Jongg tiles on a Mah-Jongg board comprising a rectangular board fitting in an opening provided in the proximity of each edge of a Mah-Jongg board, said rectangular board adapted to turn on a hinge provided on one of the transverse edges thereof, a means for conveying Mah-Jongg tiles from the feed side of the apparatus to said rectangular board, a means for arranging Mah-Jongg tiles in two horizontal rows on the feed side of the apparatus, each of said two horizontal rows consisting of seventeen Mah-Jongg tiles with the obverse upward and with the longitudinal axis of each Mah-Jongg tile placed perpendicularly to the running direction of said means for conveying Mah-Jongg tiles from the feed side of the apparatus to said rectangular board, a means for turning said two horizontal rows of Mah-Jongg tiles upside down in the course of the conveyance of Mah-Jongg tiles through said means for conveying Mah-Jongg tiles from the feed side of the apparatus to said rectangular board, a means for rearranging said two horizontal rows of Mah-Jongg tiles in two vertical tiers after said two horizontal rows of Mah-Jongg tiles are turned upside down, said means for rearranging said two horizontal rows of Mah-Jongg tiles in two vertical tiers being adjoined to said rectangular board when said rectangular board is at the lower limit of its swinging range, and a means for automatically pushing up said rectangular board to the same level with said Mah-Jongg board as soon as said two vertical tiers of Mah-Jongg tiles are delivered from said means for rearranging said two horizontal rows of Mah-Jongg tiles in two vertical tiers and transferred onto said rectangular board.

2. The apparatus as set forth in claim 1, wherein said means for conveying Mah-Jongg tiles from the feed side of the apparatus to said rectangular board comprises two side plates installed under said rectangular board so as to run parallel to the longitudinal edges thereof, three pulleys rotatably held between said two side plates, an endless belt adapted to run in the grooves provided in the rims of said three pulleys, said endless belt provided with a means for thrusting Mah-Jongg tiles, a motor driving one of said three pulleys, a guide plate joining the edges of said two side plates so as to partially surround said endless belt and adapted for guiding Mah-Jongg tiles thrusted by said means for thrusting Mah-Jongg tiles, said guide plate consisting of a straight portion forming the feed side of said guide plate and a substantially semicircular portion adjoined to said straight portion and surrounding nearly half of one of said three pulleys concentrically therewith.

3. The apparatus as set forth in claim 1, wherein said means for arranging Mah-Jongg tiles in two horizontal rows on the feed side of the apparatus comprises a rectangular cradle nearly twice as long as the width of said guide plate, one of the longitudinal edges of said rectangular cradle being adjoined to the transverse edge of said feed side of said guide plate so as to allow nearly half of said rectangular cradle to project sideways beyond the extension of the lower edge of one of said two side plates perpendicularly thereto, a means for allowing a Mah-Jongg tile to fall to the projecting portion of said cradle with the obverse upward and with the longitudinal axis of said Mah-Jongg tile placed perpendicularly to the running direction of said endless belt, a means for thrusting said Mah-Jongg tile into the portion of said cradle lying between the extensions of the lower edges of said two side plates, and a means for pushing two Mah-Jongg tiles out of said cradle so as to thrust them into the feed side of said guide plate every time two Mah-Jongg tiles are arranged in said portion of said cradle lying between the extensions of the lower edges of said two side plates.

4. The apparatus as set forth in claim 1, wherein said means for turning said two horizontal rows of Mah-Jongg tiles upside down comprises two guide rails fixed respectively to said two side plates concentrically with said semicircular portion of said guide plate so as to leave a space substantially equal to the thickness of a Mah-Jongg tile between said two guide rails and said semicircular portion of said guide plate.

5. The apparatus as set forth in claim 1, wherein said means for rearranging said two horizontal rows of Mah-Jongg tiles in two vertical tiers comprises one of said two guide rails extending straightforward subsequently to the concentricity with said semicircular portion of said guide plate, the other of said two guide rails forming a gradual ascent in relation to said one of said two guide rails until the difference of altitude comes to be substantially equal to the thickness of a Mah-Jongg tile, and a means for deflecting the Mah-Jongg tiles toward the center between said two side plates until the Mah-Jongg tiles sliding on said other of said two guide rails are laid on top of the Mah-Jongg tiles sliding on said one of said two guide rails.

6. The apparatus as set forth in claim 2, wherein said means for automatically pushing up said rectangular board to the same level with said Mah-Jongg board as soon as said two vertical tiers of Mah-Jongg tiles are delivered from said means for rearranging said two horizontal rows of Mah-Jongg tiles in two vertical tiers and transferred onto said rectangular board comprises a shaft perpendicularly fixed to said two side plates substantially under the center of said rectangular board and over said endless belt, a disk rotatably mounted on said shaft, a push-up rod radially provided on the periphery of said disk and adapted to come in a vertical state when coming in touch with a stopper, said push-up rod being just long enough to support said rectangular board on a level with said Mah-Jongg board as long as said push-up rod is in touch with said stopper, and a cam mounted on the outside surface of said endless belt and adapted to engage with a notch provided in the periphery of said disk in accordance with the delivery of said two vertical tiers of Mah-Jongg tiles.

* * * * *